US008852021B2

(12) United States Patent
Matsumoto et al.

(10) Patent No.: US 8,852,021 B2
(45) Date of Patent: Oct. 7, 2014

(54) GOLF CLUB SHAFT AND GOLF CLUB USING THE SAME

(75) Inventors: Norio Matsumoto, Osaka (JP); Takato Nakamura, Saitama (JP); Masaki Wakabayashi, Saitama (JP); Tomonobu Kanno, Minamisouma (JP)

(73) Assignee: Fujikura Rubber Ltd., Tokyo (JP)

( * ) Notice: Subject to any disclaimer, the term of this patent is extended or adjusted under 35 U.S.C. 154(b) by 171 days.

(21) Appl. No.: 13/576,011

(22) PCT Filed: Dec. 3, 2010

(86) PCT No.: PCT/JP2010/071670
§ 371 (c)(1),
(2), (4) Date: Jul. 30, 2012

(87) PCT Pub. No.: WO2011/096129
PCT Pub. Date: Aug. 11, 2011

(65) Prior Publication Data

US 2012/0295735 A1 Nov. 22, 2012

(30) Foreign Application Priority Data

Feb. 2, 2010 (JP) ..... 2010-021358

(51) Int. Cl.
*A63B 53/10* (2006.01)

(52) U.S. Cl.
USPC ..... 473/319

(58) Field of Classification Search
USPC ..... 473/319–320
See application file for complete search history.

(56) References Cited

U.S. PATENT DOCUMENTS

| | | | | | |
|---|---|---|---|---|---|
| 2,809,144 | A | * | 10/1957 | Grimes | 156/192 |
| 4,023,801 | A | * | 5/1977 | VanAuken | 473/319 |
| 5,421,573 | A | * | 6/1995 | Kawamatsu | 473/319 |
| 5,665,441 | A | | 9/1997 | Suzue et al. | |
| 5,686,155 | A | | 11/1997 | Suzue et al. | |

(Continued)

FOREIGN PATENT DOCUMENTS

| | | | | |
|---|---|---|---|---|
| CN | 101618269 | A | 1/2010 | |
| JP | 7-37860 | Y2 | 8/1995 | JP 9-131422A 5/1997 |
| JP | 11-70197 | A | 3/1999 | |
| JP | 2000-51413 | A | 2/2000 | |
| JP | 2002-45449 | A | 2/2002 | |
| JP | 2006-61473 | A | 3/2006 | |

OTHER PUBLICATIONS

International Search Report for PCT/JP2010/071670 dated Feb. 10, 2011.

(Continued)

*Primary Examiner* — Stephen L. Blau
(74) *Attorney, Agent, or Firm* — McCormick, Paulding & Huber LLP

(57) ABSTRACT

A golf club shaft in which the isotropy of the prepregs configuring a torsion rigidity holding layer is high and in which sufficient torsional rigidity can be secured with fewer plies of fewer prepregs. The golf club shaft includes a torsional rigidity holding layer made of a thermosetting resin which contains reinforced fibers extending obliquely to a longitudinal direction of the shaft. The torsional rigidity holding layer includes a multilayer set prepreg, in which at least two layers of prepregs made of reinforced fibers are impregnated with a thermosetting resin. A plurality of prepregs in the multilayer set prepreg include reinforced fibers extending in mutually different directions. The multilayer set prepreg is continuously wound by at least two turns with the plurality of prepregs layered on each other. A golf club uses the shaft.

8 Claims, 5 Drawing Sheets

(56) References Cited

U.S. PATENT DOCUMENTS

| | | | | |
|---|---|---|---|---|
| 6,273,830 | B1 * | 8/2001 | Takemura et al. | 473/319 |
| 6,306,047 | B1 * | 10/2001 | Kusumoto | 473/319 |
| 6,709,347 | B1 * | 3/2004 | Ono et al. | 473/319 |
| 6,905,422 | B2 * | 6/2005 | Atsumi et al. | 473/319 |
| 7,172,518 | B2 * | 2/2007 | Matsumoto et al. | 473/319 |
| 2006/0258478 | A1 * | 11/2006 | Hsu | 473/316 |

OTHER PUBLICATIONS

Office Action received in Chinese Patent Application 201080062837.9 dated Apr. 24, 2014.

* cited by examiner

GOLF CLUB SHAFT AND GOLF CLUB USING THE SAME

CROSS REFERENCE TO RELATED APPLICATIONS

This application claims the priority of Japanese patent application No. 2010-021358, filed on Feb. 2, 2010 and PCT Application No. PCT/JP2010/071670, filed on Dec. 3, 2010, the disclosures of which are incorporated herein by reference in their entirety.

TECHNICAL FIELD

The present invention relates to a golf club shaft (carbon shaft) which is produced by winding and thermally curing prepregs (sheets) made of thermosetting resin and a golf club using this golf club shaft.

a. BACKGROUND ART

Prepregs are known as sheet materials made of toughened fibers (reinforced fibers, carbon fibers, etc.) impregnated with an uncured thermosetting resin. In the field of golf club shafts, a plurality of prepregs are wound on a mandrel that has the shape of a tapered shaft and are thermally cured into a tapered golf club shaft.

FIG. 10 shows a typical example of a structure of a golf club shaft 1 that is configured from a plurality of prepregs. The golf club shaft 1 includes a compressive rigidity (crush rigidity) holding layer 2, a torsional rigidity holding layer 3 and a bending rigidity holding layer 4, in that order from the under layer, wherein the compressive rigidity holding layer 2 is configured from a prepreg (90-degree (hoop) layer prepreg) whose fiber direction is orthogonal to the longitudinal direction of the shaft, wherein the torsional rigidity holding layer 3 is configured from a prepreg (bias prepreg; prepreg of a 45-degree layer) whose fiber direction is inclined to the longitudinal direction of the shaft, and wherein the bending rigidity holding layer 4 is configured from a prepreg (prepreg of a 0-degree layer) whose fiber direction is parallel to the longitudinal direction of the shaft. The compressive rigidity holding layer 2 is sometimes layered on top of the torsional rigidity holding layer 3. The prepregs configuring the compressive rigidity holding layer 2 and the bending rigidity holding layer 4 are each usually referred to as an UD (unidirectional) prepreg since the fibers thereof extend in a single direction. In addition, the torsional rigidity holding layer 3 usually includes a pair of UD prepregs (45-degree layers/bias prepregs) whose fiber directions are symmetrical with respect to the longitudinal direction of the shaft (generally ±45° relative to the longitudinal direction); in addition, the applicant has also developed the golf club shaft 1 in which a plain weave fabric (biaxial woven fabric) prepreg, a triaxial woven fabric prepreg and a tetra-axial woven fabric prepreg that are made by impregnating a plain weave fabric (biaxial woven fabric), a triaxial woven fabric and a tetra-axial woven fabric with thermosetting resin are incorporated in the torsional rigidity holding layer 3.

PRIOR ART DOCUMENTS

Patent Documents

Patent Document 1: Japanese Unexamined Patent Publication No. H9-131422

Patent Document 2: Japanese Unexamined Patent Publication No. 2000-51413

Technical Problem

In the golf club shaft 1 as described above, the fiber direction of the compressive rigidity holding layer 2 is limited to 90° and the fiber direction of the bending rigidity holding layer 4 is limited to 0°. Whereas, in the torsional rigidity holding layer 3, the more diversified the directions of the fibers included therein are, the higher the isotropy (torsional strength without regard to directions), which makes it possible to achieve a feeling close to the feeling one gets when hitting a golf ball with a steel shaft. This is a chief reason why a plain weave fabric prepreg, a triaxial woven fabric prepreg and a tetra-axial woven fabric prepreg are used for the torsional rigidity holding layer 3. Using the concept "degree (rate) of isotropy (frequency)" in regard to the magnitude of isotropy, the degree of isotropy is considered to increase in the order from a pair of bias layer prepregs, a plain weave fabric prepreg, a triaxial woven fabric prepreg to a tetra-axial woven fabric prepreg. Incidentally, the degree of isotropy of a steel shaft is the highest.

However, another problem is that there is a limit in thickness (weight) of the torsional rigidity holding layer 3. As long as there is a limit in the thickness, idea way for securing sufficient torsional rigidity with less number of plies (number of turns) of less number of prepregs needs to be devised. In other words, when the same or different types of prepregs having the same number of layers are used, a structure capable of further increasing the torsional rigidity is required.

The present invention has been devised in view of the above described problems, and an object of the present invention is to achieve a golf club shaft and a golf club using the same in which the isotropy of the prepregs configuring a torsion rigidity holding layer is high, and in which sufficient torsional rigidity can be secured with less number of plies of less number of prepregs.

SUMMARY OF THE INVENTION

If the structure of a conventional torsional rigidity layer in which, after a prepreg having a specific oblique fiber direction with respect to the longitudinal direction of a golf club shaft is wound, a prepreg whose fiber direction is different from the aforementioned oblique fiber direction is wound on the aforementioned prepreg, is revised, and if these prepregs whose fiber directions are mutually different are layered in advance and wound continuously by two turns or more with the prepregs remaining layered on each other, the degree of isotropy increases as the prepregs thus layered are regarded as a single prepreg; on the other hand, as the prepregs thus layered are each regarded as an independent prepreg, on both sides of this prepreg prepregs each having a different fiber direction lie over two turns or more; accordingly, the present invention has been achieved based on the findings that deviations between layers of each prepreg (deviations between fibers of each prepreg after it is thermally cured) can be reduced to consequently be capable of enhancing the torsional rigidity.

Namely, the golf club shaft according to the present invention is characterized by including a torsional rigidity holding layer made of a thermosetting resin which contains reinforced fibers extending obliquely to a longitudinal direction of the shaft, wherein the torsional rigidity holding layer comprises a multilayer set prepreg, in which at least two layers of prepregs made of reinforced fibers are impregnated with a thermosetting resin, wherein a plurality of prepregs in the multilayer set prepreg include reinforced fibers extending in mutually different directions; and wherein the multilayer set prepreg is continuously wound by at least two turns with the plurality of prepregs layered on each other.

In this specification, the term "reinforced fibers" denote not only carbon fibers but also various types of fibers such as alumina fibers, aramid fibers, Tyranno fibers, amorphous fibers, glass fibers, etc.

The multilayer set prepreg can be provided with a pair of multilayer set prepregs whose winding directions are mutually opposite.

It is desirable for the multilayer set prepreg to include a fabric prepreg which is made by impregnating fiber-reinforced fabric with a thermosetting resin, and a UD prepreg which is made by impregnating reinforced fibers arranged to extend in a single direction with a thermosetting resin. In this case, the fiber-reinforced fabric includes at least one of a plain weave fabric, a triaxial woven fabric and a tetra-axial woven fabric. In addition, it is possible for the UD prepreg includes a pair of oblique UD prepregs whose fiber directions are symmetrical with respect to the longitudinal direction of the shaft.

The golf club shaft according to the present invention can further include a compressive rigidity holding layer which is configured from a UD prepreg whose fiber direction is orthogonal to the longitudinal direction of the shaft, and(or) can further include a bending rigidity holding layer which is configured from a UD prepreg whose fiber direction is parallel to the longitudinal direction of the shaft.

The golf club shaft according to the present invention further includes a decorative layer which is included in an outermost layer of the shaft and configured from a UD prepreg whose fiber direction is parallel to the longitudinal direction of the shaft.

A golf club according to the present invention includes a club head and a grip that are fixed to the golf club shaft having the above-described configuration.

Advantageous Effects of Invention

According to the present invention, a golf club shaft and a golf club using such a golf club shaft can be achieved, in which the isotropy of the prepregs configuring a torsion rigidity holding layer is high and in which sufficient torsional rigidity can be secured with less number of plies of less number of prepregs.

a. DESCRIPTION OF THE PREFERRED EMBODIMENTS

Each embodiment of a golf club shaft according to the present invention will be hereinafter discussed with reference to the accompanying drawings. In this specification, the term "isotropy" means torsional strength without regard to the orientation of the golf club shaft.

First Embodiment

Figure 1:
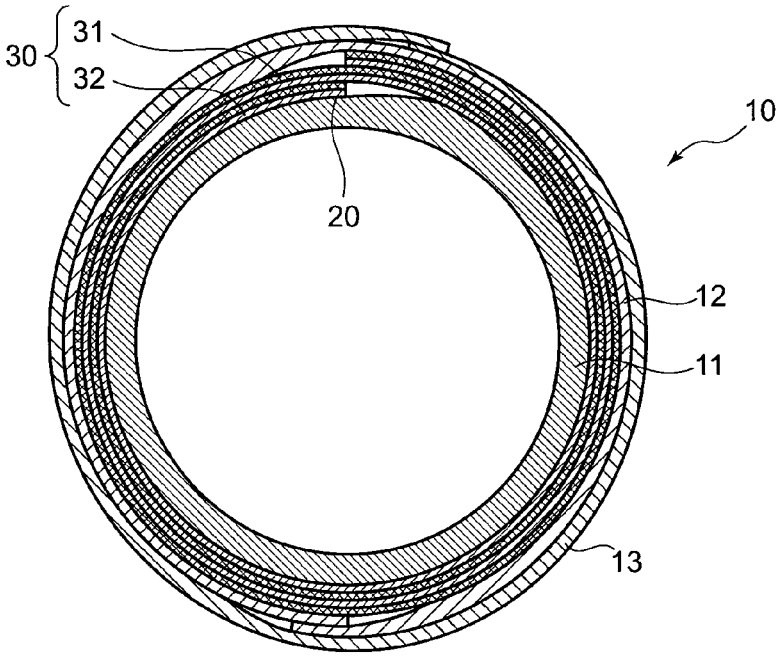
FIG. 1 is a schematic sectional view of a first embodiment of a golf club shaft according to the present invention, taken along a plane orthogonal to the longitudinal direction of the shaft.

FIG. 1 is a schematic sectional view of a first embodiment of a golf club shaft 10 according to the present invention. As known in the art, the golf club shaft 10 is formed into a tapered cylinder, the outer diameter of which gradually increases toward the large-diameter proximal end from the small-diameter distal end, a club head is fixed to the small-diameter end of the shaft, and a grip is fixed to the large-diameter end of the shaft; however, the illustration of this structure is omitted in the drawings.

Figure 10:
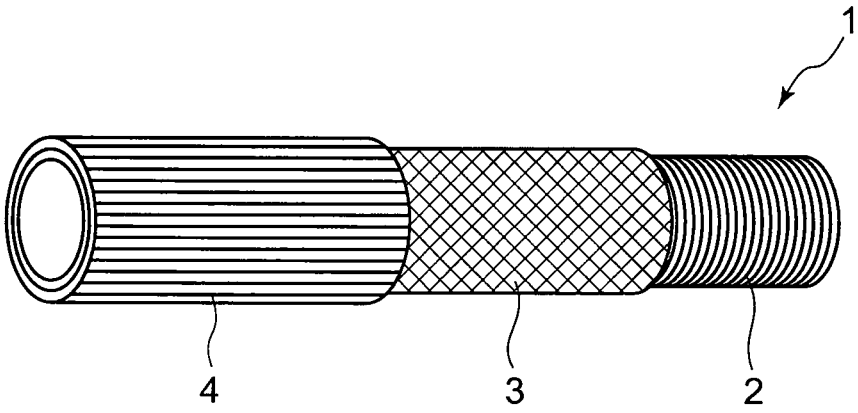
FIG. 10 is a schematic perspective view of a typical conventional golf club shaft, showing an configuration example thereof.

Similar to the conventional product shown in FIG. 10, the golf club shaft 10 is provided with a compressive rigidity (crush rigidity) holding layer 11, a torsional rigidity holding layer 20, a bending rigidity holding layer 12 and a decorative layer (polished layer/bending rigidity holding layer) 13, in that order from under (inner) layer. In FIG. 1, the thickness and difference in level of each of these layers 11, 20, 12 and 13 is exaggerated for the sake of illustration. Although the layers 11, 20, 12 and 13 are drawn in FIG. 1 in a manner such that there are gaps in the vicinity of the winding commencement/termination positions of the layers 11, 20, 12 and 13, these gaps are filled with a thermosetting resin when the layers 11, 20, 12 and 13 are thermally cured. In addition, since a feature of the present embodiment resides in the structure of the torsional rigidity holding layer 20 and since the compressive rigidity holding layer 11 and the bending rigidity holding layer 12 have (can be made to have) the same structure as those shown in FIG. 10, the cross sectional shapes of the layers 11 and 12 are not shown in the drawings. In general, the compressive rigidity holding layer 11 is configured from a UD prepreg of a 90-degree layer whose fiber direction is orthogonal to the longitudinal direction of the shaft, while the bending rigidity holding layer 12 is configured from a UD prepreg of a 0-degree layer whose fiber direction is parallel to the longitudinal direction of the shaft. The ply number of the prepreg of each of the compressive rigidity holding layer 11 and the bending rigidity holding layer 12 is determined according to specifications required for the shaft, with consideration given to the physical properties of the reinforced fibers contained in the prepreg and the thermosetting resin with which the prepreg is impregnated. The decorative layer (polished layer/bending rigidity holding layer) 13 is included in an outermost layer of said shaft 10 and configured from a UD prepreg of a 0-degree layer whose fiber direction is parallel to the longitudinal direction of the shaft. By polishing the decorative layer 13, the bending rigidity of the shaft is adjusted while the appearance of the shaft is enhanced. Each of the compressive rigidity holding layer 11, the torsional rigidity holding layer 20, the bending rigidity holding layer 12 and the decorative layer 13 are full-length layers which extend over the full length of the golf club shaft 10. A short-length prepreg is sometimes wound around the small-diameter distal end and (or) the large-diameter proximal end as needed (according to an ordinary manner).

The torsional rigidity holding layer 20 is configured from a multilayer set prepreg 30 which is continuously wound by two turns, and the multilayer set prepreg 30 is made of a triaxial woven fabric prepreg 31 and a UD prepreg 32 which are layered on each other. Namely, the triaxial woven fabric prepreg 31 and the UD prepreg 32 are previously layered to be formed into the multilayer set prepreg 30, which in turn is wound on the compressive rigidity holding layer 11 that is wound on a conical mandrel. The bending rigidity holding layer 12 is wound onto the multilayer set prepreg 30 and thermally cured according to an ordinary method to form the golf club shaft 10. As known in the art, the prepreg of the compressive rigidity holding layer 11, the prepreg of the bending rigidity holding layer 12, the triaxial woven fabric prepreg 31 and the UD prepreg 32 are each usually formed into a flat trapezoidal shape so that the ply number is an integer across the entire length when wound on a mandrel.

Figure 2:
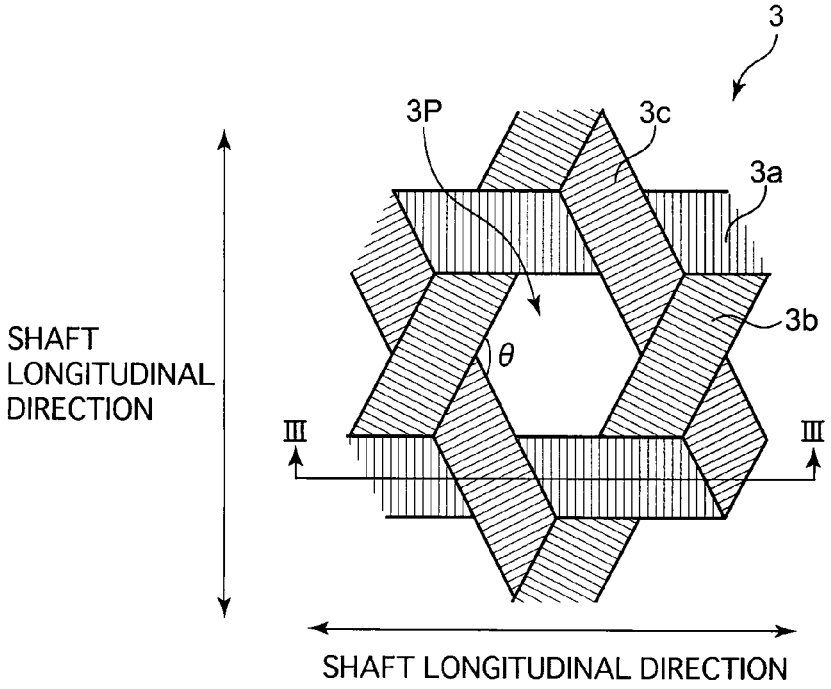
FIG. 2 is a plan view of a triaxial woven fabric.
Figure 3:
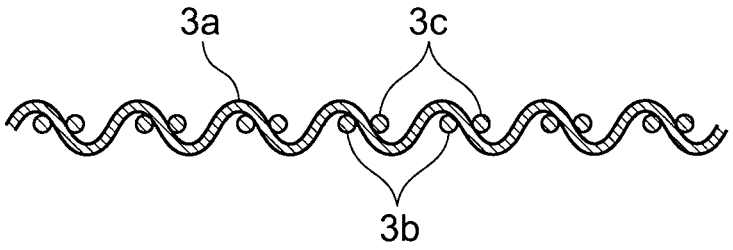
FIG. 3 is a sectional view taken along the line III-III shown in FIG. 2.

FIGS. 2 and 3 show conceptual diagrams of a triaxial woven fabric 3 that is included in the triaxial woven fabric prepreg 31. The triaxial woven fabric 3 is provided with first warp threads 3*b* and second warp threads 3*c* which extend obliquely to weft threads 3*a*, and the weft threads 3*a* and the warp threads 3*b* and 3*c* are woven to be mutually laced over and under one another so as to form hexagonal void spaces 3P between textures thereof. Ideally, the angle of each thread with respect to another thread is 120°. Since triaxial woven fabrics have a quasi-isotropic structure, deforming or warping thereof does not easily occur, even independently, compared with UD prepregs. In addition, when winding the triaxial woven fabric prepreg 31, for instance, the triaxial woven fabric prepreg 31 can be wound with the weft threads 3*a* extending in the longitudinal direction of the shaft or in a direction orthogonal to the longitudinal direction of the shaft; however, even if there is a deviation in the winding direction, the reinforced fibers extending obliquely to the longitudinal direction of the shaft will always be included in the golf club shaft 10.

Figure 4:
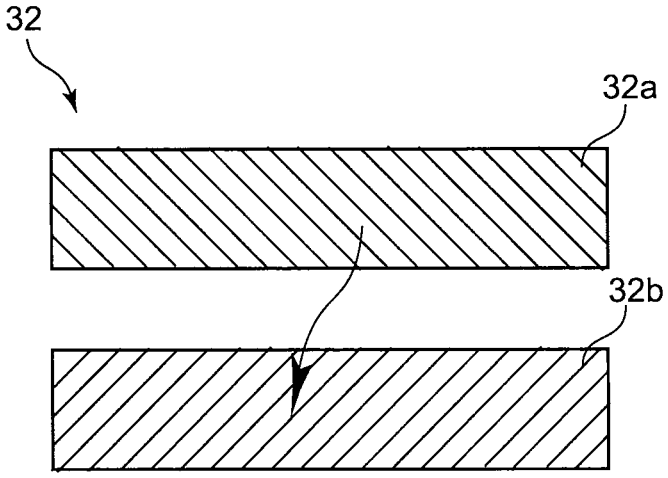
FIG. 4 is a conceptual plan view of an UD prepreg consisting of two UD prepregs in which the directions of the reinforced fibers thereof are symmetrical with respect to the longitudinal direction of the shaft.

As shown in FIG. 4, the UD prepreg 32 is configured from two oblique UD prepregs 32*a* and 32*b*, the reinforced fiber directions of which are symmetrical with respect to the longitudinal direction of the shaft. The oblique directions of the reinforced fibers contained in the two oblique UD prepregs 32*a* and 32*b* with respect to the longitudinal direction of the shaft are generally set in the range from 30 to 60°, though not limited solely to these particular angles.

If only the triaxial woven fabric prepreg 31 is wound a plurality of turns, layers of the triaxial woven fabric prepreg 31 come in contact each other; however, gaps easily occur between the layers because the triaxial woven fabric prepreg is made by weaving yarns extending in three different directions, and therefore has bumps and dips. In contrast, bumps and dips which are created between layers are reduced if the triaxial woven fabric prepreg 31 and the UD prepreg 32 are layered to be formed into the multilayer set prepreg 30 as described in the present embodiment, which makes it possible to make displacements between layers of the triaxial woven fabric prepreg 31 and the UD prepreg 32 (displacements between fibers) extremely difficult to occur when the thermosetting resin of the prepregs is thermally cured. In addition, the triaxial woven fabric prepreg 31 and the UD prepreg 32 can be prevented from being mutually torsionally deformed because reinforced fibers extending in mutually different directions are included in the triaxial woven fabric prepreg 31 and the UD prepreg 32.

Additionally, since the triaxial woven fabric prepreg 31 and the UD prepreg 32 (32*a* and 32*b*) that are mutually different in fiber direction are wound as a set of layers, not as separate layers, the multilayer set prepreg 30 can be regarded as a single layer; consequently, the isotropy of the golf club shaft 10 can be increased. In other words, if the triaxial woven fabric prepreg 31 and the UD prepreg 32 (32*a* and 32*b*) are wound as separate layers, the isotropy of the golf club shaft 10 will be the mere sum of the isotropy of the triaxial woven fabric prepreg 31 and the isotropy of the UD prepreg 32. However, if the triaxial woven fabric prepreg 31 and the UD prepreg 32 (32*a* and 32*b*) are continuously wound while being layered onto each other, a high isotropy which dramatically exceeds the mere sum of the isotropy of the triaxial woven fabric prepreg 31 and the isotropy of the UD prepreg 32 is shown, even though the prepregs used are exactly the same. This makes it possible to achieve the golf club shaft 10 that provides a feeling close to the feeling one gets when hitting a golf ball with a steel shaft, the isotropy of which is high.

Additionally, when the triaxial woven fabric prepreg 31 and the UD prepreg 32 (32*a* and 32*b*) of the multilayer set prepreg 30 are each regarded as an independent layer, both sides of this prepreg prepregs each have a different fiber direction lying over two turns or more; accordingly, deviations between layers of each prepreg (deviations between fibers of each prepreg after it is thermally cured) can be reduced to consequently be capable of enhancing the torsional rigidity. Namely, the triaxial woven fabric prepreg 31 and the UD prepreg 32 (32*a* and 32*b*) that are respectively positioned on the inside and outside adjacent to each other press against each other to prevent themselves from moving; consequently, deviations between layers (deviations between fibers) can be reduced to thereby make it possible to enhance the torsional rigidity.

In addition to carbon fibers, alumina fibers, aramid fibers, Tyranno fibers, amorphous fibers and glass fibers, etc., can be selectively used as reinforced fibers included in the prepregs constituting the compressive rigidity holding layer 11 and the bending rigidity holding layer 12, the triaxial woven fabric prepreg 31 and the UD prepreg 32. In other words, the type of yarn used is basically not limited.

It is desirable that the yarn size of each yarn be 3K (1K denotes 1000 filaments) or less. If the yarn size exceeds 3K, the prepreg becomes excessively thick and a sufficient fiber density (thread count) may not be secured; in addition, the workability when winding the prepreg around a mandrel may deteriorate.

It is possible to basically use any kind of resin as the resin with which such reinforced fibers are impregnated. For instance, it is possible to use epoxy resin, unsaturated polyester resin, phenolic resin, vinylester resin, PEEK resin, or the like.

It is desirable that the thickness of each prepreg, specifically each UD prepreg be in the range from 0.02 to 0.25 mm and each fabric prepreg be in the range from 0.06 to 0.30 mm. If the thickness of the UD prepreg (fabric prepreg) is smaller than 0.02 mm (0.06 mm), it is difficult to obtain a satisfactory rigidity. If the thickness of the UD prepreg (fabric prepreg) exceeds 0.25 mm (0.30 mm), there is a possibility of the rigidity dispersing in the longitudinal direction of the shaft.

It is desirable that the weight of each prepreg be 400 g/m$^2$ or less. If the weight exceeds 400 g/m$^2$, the prepreg may become too thick, thus becoming difficult to wind around a mandrel.

It is desirable that the resin quantity of each prepreg, specifically each UD prepreg be in the range from 20 to 50 wt % and each fabric prepreg be in the range from 30 to 60 wt %. If the resin quantity of the UD prepreg (fabric prepreg) is smaller than 20 wt % (30 wt %), the resin quantity is too small, so that a satisfactory shaft may not be produced. If the resin quantity of the UD prepreg (fabric prepreg) exceeds 50 wt % (60 wt %), a sufficient rigidity may not develop if the weight of the shaft is the same.

The number of turns of the multilayer set prepreg 30 in the above illustrated embodiment is "2" but can be more than 2 on the basis of specifications required for the shaft in consideration of the physical properties of the reinforced fibers and the thermosetting resin and others.

Second Embodiment

Figure 5:
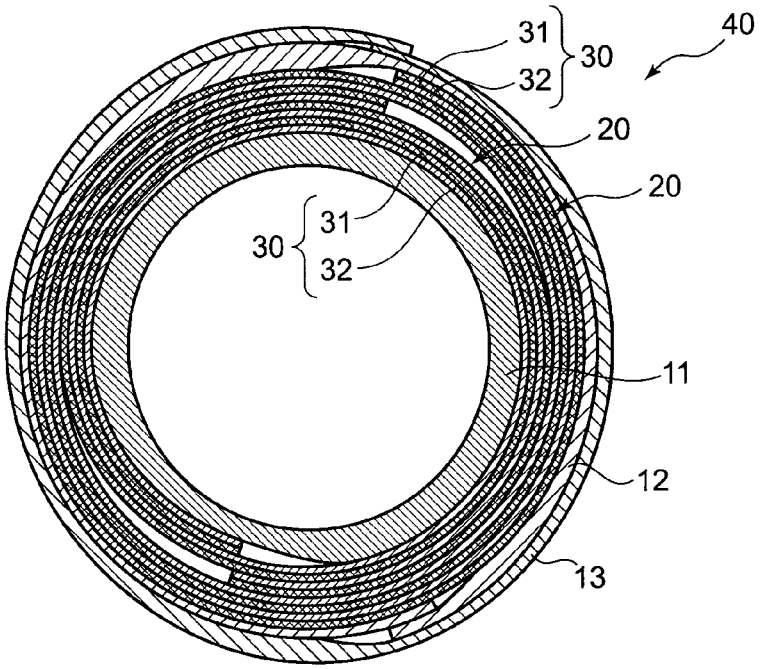
FIG. 5 is a schematic sectional view of a second embodiment of the golf club shaft according to the present invention, taken along a plane orthogonal to the longitudinal direction of the shaft.

FIG. 5 is a schematic sectional view of a second embodiment of a golf club shaft 40 according to the present invention. In this embodiment, the golf club shaft 40 is provided with two multilayer set prepregs 30 (two torsional rigidity holding layers 20), each of which is wound two turns and has been described above with reference to FIGS. 1 through 4, and the winding directions of the two multilayer set prepregs 30 are made mutually opposite (one of the two winding directions is clockwise and the other counterclockwise). Due to the golf club shaft 40 that has been structured as described above, the directional property determined by prepreg winding is eliminated; moreover, deformations and deviations which may occur between layers in a circumferential direction can be securely prevented from occurring. In other words, the uniformity of the torsional rigidity holding layers 20 in a circumferential direction increases, the strength increases, and the outward appearance becomes better.

Third Embodiment

Figure 6:
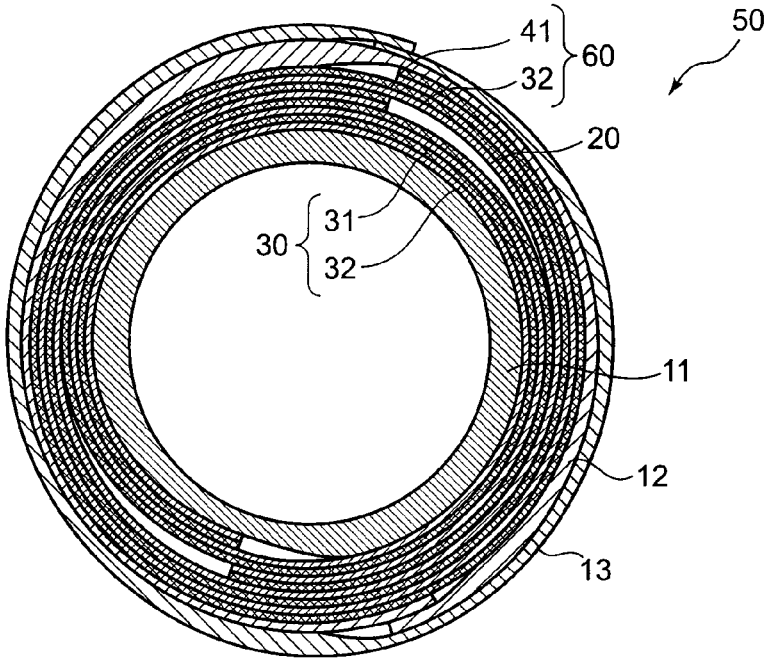
FIG. 6 is a schematic sectional view of a third embodiment of the golf club shaft according to the present invention, taken along a plane orthogonal to the longitudinal direction of the shaft.

FIG. 6 is a schematic sectional view of a third embodiment of a golf club shaft 50 according to the present invention. In this embodiment, a multilayer set prepreg 60 which is made by layering a plain weave fabric (biaxial woven fabric) prepreg 41, which is made by impregnating a plain weave fabric (biaxial woven fabric) with a thermosetting resin, and a UD prepreg 32 on each other is ready made, and then the multilayer set prepreg 60 is continuously wound by two turns onto the multilayer set prepreg 30 that has been described above with reference to FIG. 1 in a winding direction opposite to the winding direction of the multilayer set prepreg 30.

Figure 7:
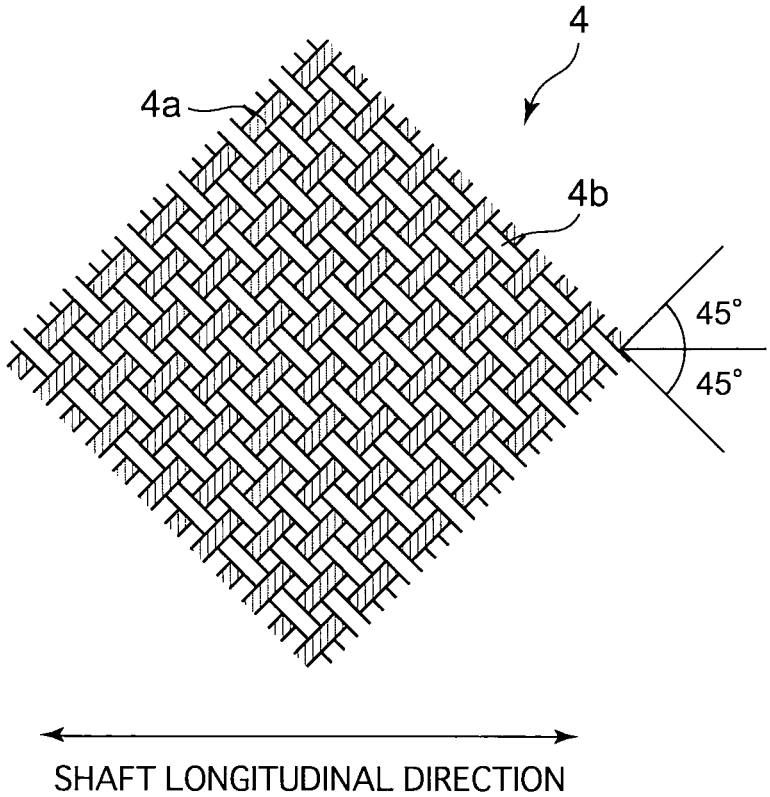
FIG. 7 is a plan view of a plain weave fabric.
Figure 8:
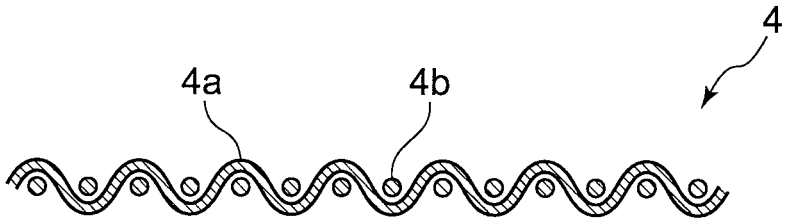
FIG. 8 is a sectional view of the plain weave fabric.

FIGS. 7 and 8 are conceptual diagrams of a plain weave fabric 4 which is included in the plain weave fabric prepreg 41. The plain weave fabric 4 has a structure in which weft threads 4*a* and warp threads 4*b* are mutually orthogonal to each other and are woven. Moreover, the plain weave fabric prepreg 41 is wound so that the weft threads 4*a* and the warp threads 4*b* are mutually crossed ideally at an angle of 45° relative to the longitudinal direction of the shaft. Although the angle of the weft threads 4*a* and the warp threads 4*b* relative to the longitudinal direction of the shaft sometimes deviates slightly from 45° depending on winding, since a mandrel is conical in shape, the weft threads 4*a* and the warp threads 4*b* are stable because the angle between the weft threads 4*a* and the warp threads 4*b* is 90°.

Figure 9:
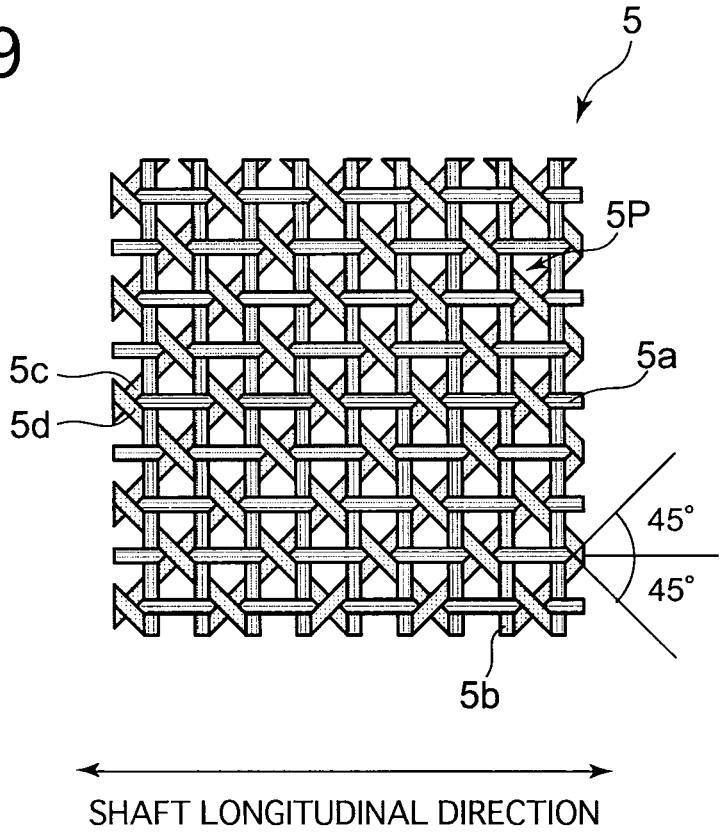
FIG. 9 is a plan view of a tetra-axial woven fabric.

A tetra-axial woven fabric prepreg made by impregnating a tetra-axial woven fabric with a thermosetting resin can be used instead of the triaxial woven fabric prepreg 31 or the plain weave fabric prepreg 41 in the above described embodiments. FIG. 9 shows a tetra-axial woven fabric 5 included in a tetra-axial woven fabric prepreg. The tetra-axial woven fabric 5 is provided with a set of vertical axis threads 5*a* which extend parallel to the longitudinal direction of the shaft, a set of lateral axis threads 5*b* which extend orthogonal to the vertical axis threads 5*a*, and two sets of oblique axis threads 5*c* and 5*d*, each set of which extends obliquely to both the vertical axis threads 5*a* and the lateral axis threads 5*b* so as to intersect therewith at symmetrical angles (e.g., +45 degrees and −45 degrees) with respect to the vertical axis threads 5*a* and the lateral axis threads 5*b*. The woven fabric structure of the tetra-axial woven fabric 5 is such that the vertical axis threads 5*a*, the lateral axis threads 5*b*, the oblique axis threads 5*c* and the oblique axis threads 5*d* are mutually laced over and under one another. The vertical axis threads 5*a*, the lateral axis threads 5*b*, the oblique axis threads 5*c* and the oblique axis threads 5*d* are woven so as to form pentagonal void spaces 5P therebetween. A tetra-axial woven fabric prepreg is made by impregnating the tetra-axial woven fabric 5 of such a kind with an uncured thermosetting resin. The intersecting angle between the vertical axis threads 5*a* (the lateral axis threads 5*b*) and the oblique axis threads 5*c* (the oblique axis threads 5*d*) is not limited to any particular angle.

Although the multilayer set prepreg is configured from a combination of a triaxial woven fabric prepreg and a UD prepreg, a combination of a plain weave fabric prepreg and a UD prepreg, or a combination of a tetra-axial woven fabric prepreg and a UD prepreg in the above described embodiments, these combinations are mere examples; the present invention basically is established if only reinforced fibers extending in mutually different directions are included in a plurality of prepregs in a multilayer set prepreg. Examples of available combinations of prepregs are listed below in TABLE 1.

TABLE 1

| COMBINATIONS OF PREPREGS CONFIGURING MULTILAYER SET PREPREGS |
|---|
| 1 UD Prepreg + UD Prepreg |
| 2 UD Prepreg + Plain Weave Fabric Prepreg |
| 3 UD Prepreg + Triaxial Woven Fabric Prepreg |
| 4 UD Prepreg + Tetra-axial Woven Fabric Prepreg |
| 5 Plain Weave Fabric Prepreg + Plain Weave Fabric Prepreg |
| 6 Plain Weave Fabric Prepreg + Triaxial Woven Fabric Prepreg |
| 7 Plain Weave Fabric Prepreg + Tetra-axial Woven Fabric Prepreg |
| 8 Triaxial Woven Fabric Prepreg + Triaxial Woven Fabric Prepreg |
| 9 Triaxial Woven Fabric Prepreg + Tetra-axial Woven Fabric Prepreg |
| 10 Tetra-axial Woven Fabric Prepreg + Tetra-axial Woven Fabric Prepreg |

Even if a multilayer set prepreg is configured from any of the combinations above, a high isotropy which dramatically exceeds a mere sum of the isotropy of all the prepregs is shown compared with the case where each prepreg is wound independently of another prepreg though the prepregs used are exactly the same. In addition, as a result of prepregs, which are positioned adjacent to each other on the inside and outside thereof, pressing against each other to prevent themselves from moving, deviations between layers (deviations between fibers) can be reduced to thereby make it possible to enhance the torsional rigidity.

Additionally, it is possible to provide the torsional rigidity holding layer with rigidity against compression (crushing) and bending by making a multilayer set prepreg include a UD prepreg of a 0-degree layer whose fiber direction is parallel to the longitudinal direction of the shaft and a UD prepreg of a 90-degree layer whose fiber direction is orthogonal to the longitudinal direction of the shaft.

Although the compressive rigidity holding layer 11, the torsional rigidity holding layer(s) 20, the bending rigidity holding layer 12 and the decorative layer 13 are arranged in that order from the under (inner) layer in the above described embodiments, the upper-lower (inner-outer) positional relationship between these layers is flexible. For instance, it is possible to change the arrangement of the compressive rigidity holding layer 11 and the torsional rigidity holding layer(s) 20; namely, it is possible that the torsional rigidity holding layer(s) 20, the compressive rigidity holding layer 11, the bending rigidity holding layer 12 and the decorative layer 13 be arranged in that order from the under (inner) layer.

Industrial Applicability

A golf club shaft according to the present invention and a golf club using this golf club shaft are suitably used in, e.g., playing golf.

A. Reference Signs List

10 40 50 Golf club shaft
11 Compressive rigidity (crush rigidity) holding layer
12 Bending rigidity holding layer
13 Decorative layer (polished layer/bending rigidity holding layer)
20 Torsional rigidity holding layer
30 60 Multilayer set prepreg
31 Triaxial woven fabric prepreg
32 UD prepreg
32*a* 32*b* Oblique UD prepreg
3 Triaxial woven fabric
41 Plain weave fabric (biaxial woven fabric) prepreg
4 Plain weave fabric (biaxial woven fabric)
5 Tetra-axial woven fabric

The invention claimed is:

1. A golf club shaft comprising a torsional rigidity holding layer made of a thermosetting resin which contains reinforced fibers extending obliquely to a longitudinal direction of said shaft, wherein said torsional rigidity holding layer comprises a multilayer set prepreg, in which at least two layers of prepregs made of reinforced fibers are impregnated with a thermosetting resin, wherein a plurality of prepregs in said multilayer set prepreg include reinforced fibers extending in mutually different directions, wherein said multilayer set prepreg is continuously wound by at least two turns with said plurality of prepregs layered on each other, and wherein said multilayer set prepreg comprises a pair of multilayer set prepregs whose winding directions are mutually opposite.

2. The golf club shaft according to claim 1, wherein said multilayer set prepreg comprises a fabric prepreg which is made by impregnating fiber-reinforced fabric with a thermosetting resin, and a UD prepreg which is made by impregnating reinforced fibers arranged to extend in a single direction with a thermosetting resin.

3. The golf club shaft according to claim 2, wherein said fiber-reinforced fabric comprises at least one of a plain weave fabric, a triaxial woven fabric and a tetra-axial woven fabric.

4. The golf club shaft according to claim 2, wherein said UD prepreg comprises a pair of oblique UD prepregs whose fiber directions are symmetrical with respect to said longitudinal direction of the shaft.

5. The golf club shaft according to claim 1, further comprising a compressive rigidity holding layer which is configured from a UD prepreg whose fiber direction is orthogonal to said longitudinal direction of said shaft.

6. The golf club shaft according to claim 1, further comprising a bending rigidity holding layer which is configured from a UD prepreg whose fiber direction is parallel to said longitudinal direction of said shaft.

7. The golf club shaft according to claim 1, further comprising a decorative layer which is included in an outermost layer of said shaft and configured from a UD prepreg whose fiber direction is parallel to said longitudinal direction of said shaft.

8. A golf club comprising said golf club shaft according to claim 1, to which a golf club head and a grip are fixed.

* * * * *